US006601951B2

(12) United States Patent
Kuwabara et al.

(10) Patent No.: US 6,601,951 B2
(45) Date of Patent: Aug. 5, 2003

(54) PRINTERS AND PRINTING METHOD

(75) Inventors: Akitomo Kuwabara, Hitachinaka (JP); Shuho Yokokawa, Hitachinaka (JP); Isao Nakajima, Hitachinaka (JP); Katsumi Ishizawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/915,380

(22) Filed: Jul. 27, 2001

(65) Prior Publication Data

US 2002/0011170 A1 Jan. 31, 2002

(30) Foreign Application Priority Data

Jul. 28, 2000 (JP) ..... 2000-228128

(51) Int. Cl.[7] ..... B41F 23/04; B41J 15/00

(52) U.S. Cl. ..... 347/101; 347/102; 346/136; 101/487; 400/579; 400/618

(58) Field of Search ..... 346/136; 347/16, 347/101, 102, 104, 139, 164, 218, 219, 262, 264; 399/44, 395; 400/579, 618; 101/487, 488

(56) References Cited

U.S. PATENT DOCUMENTS 3,570,735 A * 3/1971 Kurz ..... 226/3
3,973,489 A * 8/1976 Black ..... 101/115
4,000,035 A * 12/1976 Schiel et al. ..... 162/290
5,488,399 A 1/1996 Mitomi et al. ..... 347/43
5,539,498 A * 7/1996 De Cock et al. ..... 399/44
5,828,930 A 10/1998 Matsumoto et al. ..... 399/135
5,896,154 A * 4/1999 Mitani et al. ..... 347/102
6,210,049 B1 * 4/2001 Yamada et al. ..... 396/575

FOREIGN PATENT DOCUMENTS

| | | |
|---|---|---|
| CH | 331874 | 9/1958 |
| GB | 370134 | 4/1932 |
| JP | 05-208778 | 8/1993 |
| WO | WO 95/19929 | 7/1995 |

* cited by examiner

*Primary Examiner*—Huan Tran
*Assistant Examiner*—Blaise Mouttet
(74) *Attorney, Agent, or Firm*—Antonelli, Terry, Stout & Kraus, LLP

(57) ABSTRACT

A printer has a web handling unit that includes a web conditioning device for providing fixed control of the moisture within the web being fed, a skew correction device for adjusting the traveling position of the web which has passed through the web conditioning device, and a tension assigning device for assigning fixed tension to the web. The printer also includes an image forming device that forms an image on the web transported from the web handling unit.

14 Claims, 3 Drawing Sheets

PRINTERS AND PRINTING METHOD

BACKGROUND OF THE INVENTION

The present invention relates to printers and to a printing method; and more, particularly, the invention relates to printers which form images on continuous webs that are fed at high speed.

In the general types of printers that form images on webs, pin members of a tractor mechanism mounted on the printer are engaged with feed holes disposed along the edges of the web, and the tractor mechanism is driven to feed the web as an image is formed thereon using the image forming section of the printer. After the web with the feed holes has been printed, however, the portions of the web in which these feed holes (usually, the left and right edges of the web) are provided need to be cut off, and thus additional time is spent after printing in obtaining the final printed matter. Also, the printer itself requires a tractor mechanism as a component thereof, and so such a printer inherently has a complex configuration. Such a cutting operation as mentioned above can be omitted by adopting webs that are free of feed holes, using a web roller mechanism instead of a tractor mechanism of the printer.

In this regard, for a printer that uses webs that are free of feed holes and which forms an image on a web while feeding it by use of a feed roller mechanism, if this printer is of the type which operates in no higher than a middle-speed region in which only about 50 pages per minute are printed on A4-paper on a horizontal feed basis, printing not conspicuous in terms of print position offsets is possible, since not too significant slipping occurs between the web and the feed rollers. If, however, the printer is of the high-speed type that is capable of printing more than 100 pages per minute, or is of the ultrahigh-speed region type that is capable of printing more than 200 pages per minute, it is difficult with a conventional configuration to feed the web to the image forming section accurately, with the result that a need arises to control the tension, traveling position, moisture, etc. of the web being fed.

SUMMARY OF THE INVENTION

A primary object of the present invention is to provide a printer and printing method that enables stable feed of webs with high accuracy by maintaining almost constant web status, irrespective of the web type, prior to feeding the web to the image forming section of the printer.

A secondary object of the present invention is to provide a printer by which the image formed on a web fed at high speed can be fixed or dried using a compact heating means.

The objects set forth above can be achieved by providing a printer having a web handling unit comprising a web conditioning means for providing fixed control of the moisture within the web being fed, a skew correction means for adjusting the traveling position of the web which has passed through said web conditioning means, and a tension assigning means for assigning fixed tension to the web,and an image forming means that forms an image on the web sent from said web handling unit.

DETAILED DESCRIPTION OF PREFERRED EMBODIMENTS

Figure 1:
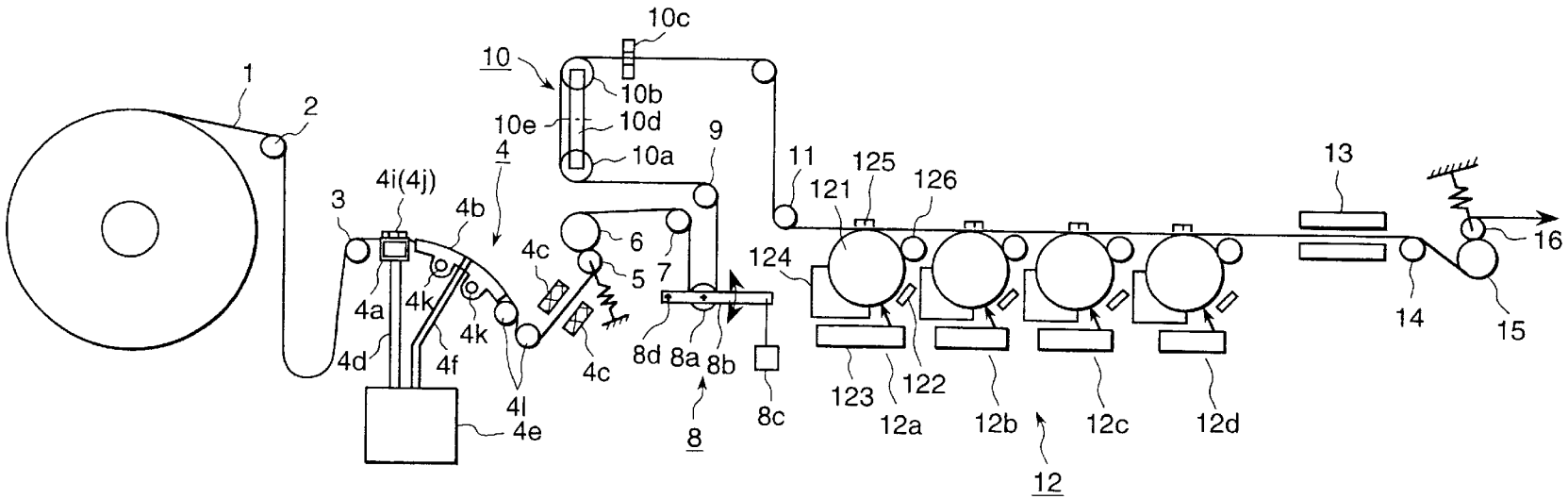
FIG. 1 is an overall block diagram of a printer representing an embodiment of the present invention.

Embodiments of the present invention will be described below with reference to the drawings. FIG. 1 is a schematic diagram showing an embodiment of the printer pertaining to the present invention.

Numeral 1 in FIG. 1 denotes a web. Web 1 is made from paper, a plastic film, or the like, and the configuration employed when using a web wound into a roll is shown in this embodiment. Web 1 is conveyed into web conditioning means 4 via guide rollers 2 and 3 arranged on the web feed route.

Figure 2:
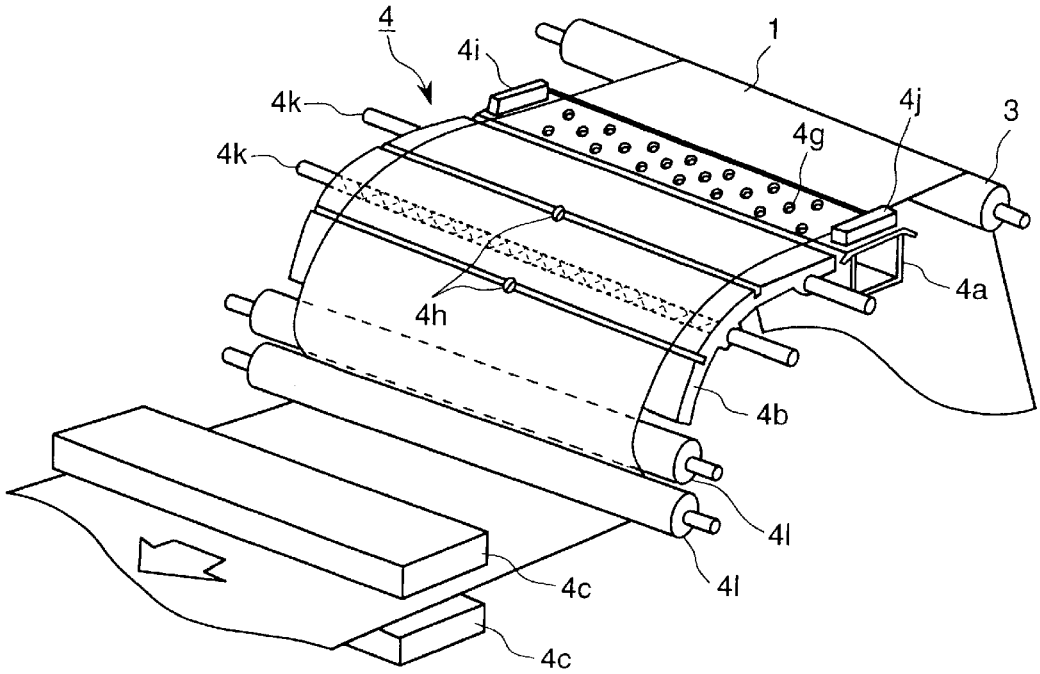
FIG. 2 is a perspective view of the web conditioning means.

Conditioning means 4 is equipped with a suction box 4*a*, a suction heater 4*b*, and web coolers 4*c*. In this configuration, the suction box 4*a* is connected to a blower 4*e* via a duct 4*d*, and similarly, the suction heater 4*b* is connected to the blower 4*e* via a duct 4*f*. And, as shown in FIG. 2, since through-holes 4*g* and 4*h* for suction are formed in the surfaces of the suction box 4*a* and the suction heater 4*b*, respectively, when the blower 4*e* is operated and a suction force is generated, the suction force is applied to the surfaces of the suction box 4*a* and the suction heater 4*b* during the passage of web 1 along the surfaces of the suction box and the suction heater. The suction force here is preset to such a relatively low pressure as to enable web guides 4*i* and 4*j* on the suction box 4*a* to adjust the traveling position of web 1 when it is passed between the web guides 4*i* and 4*j*.

Also, the suction heater 4*b* has a heater element 4*k*, including a heater lamp, a sheathed heater, etc., and the suction heater 4*b* is constructed so that, when the heater element 4*k* is operated, the surface of the suction heater 4*b* is heated to the required temperature.

Figure 4:
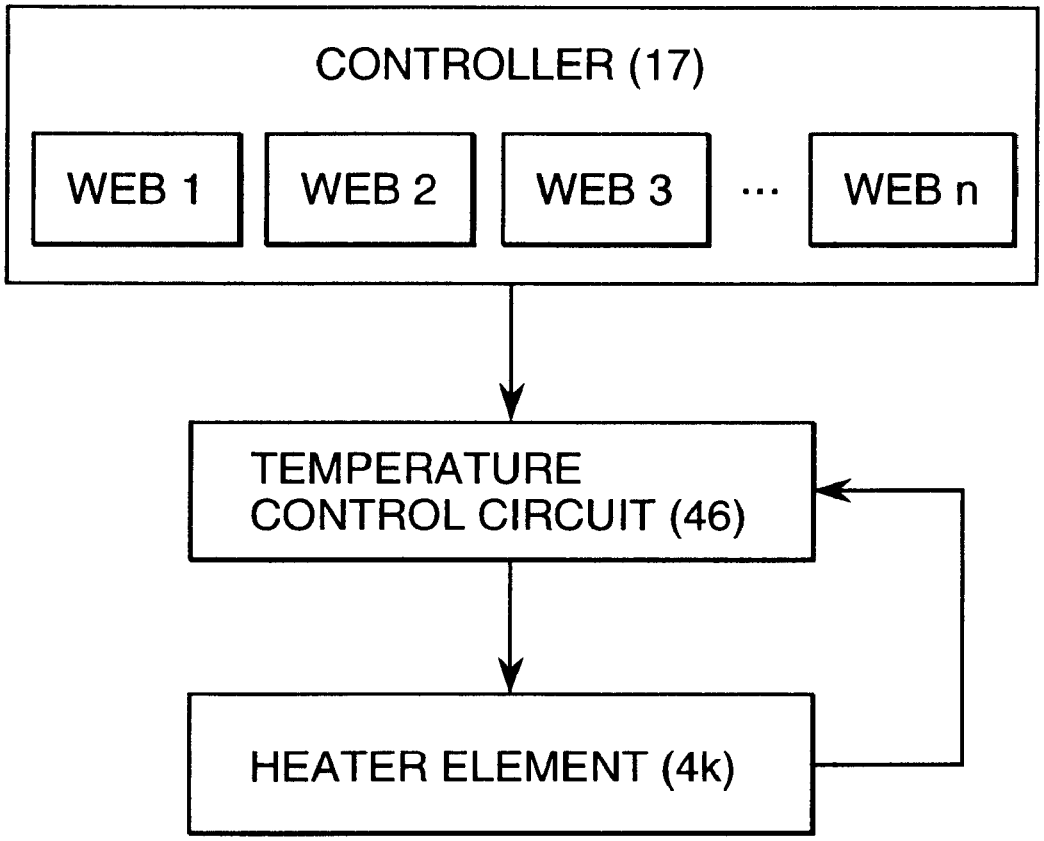
FIG. 4 is a control block diagram of the heater element.

With this configuration, data that has been obtained from experiments (data on the width of the web, on the ream weight, and on moisture content) is stored within the controller 17 shown in FIG. 4. Thus, when "Web 1" is selected, power will be supplied to heater element 4*k* under, for example, heating conditions suitable for a thin web, and the surface temperature of suction heater 4*b* will be controlled accordingly; and, when "Web 2" is selected, the heating conditions will be changed to those suitable for a web that is slightly thicker than in the case of "Web 1", and then power will be supplied to heater element 4*k* to control the surface temperature of suction heater 4*b*. Near the surface of suction heater 4*b* there is provided a temperature sensor (not shown in the figure) whose output signal is used to provide feedback control in order to maintain the surface temperature of suction heater 4*b* at a fixed value.

Any web type from "Web 1" to "Web n" is manually switch-selectable by the operator or is automatically selectable in accordance with the output signal of a measuring instrument which can measure the thickness of the web on its delivery route.

Furthermore, the method of selection of heating conditions does not always need to be limited to step-by-step selection from "Web 1" to "Web n". Instead, power to heater element 4*k* can be controlled more precisely, in accordance with the output signal of a humidity measuring instrument provided upstream in the feed direction of the web with respect to suction heater 4*b*.

Figure 3:
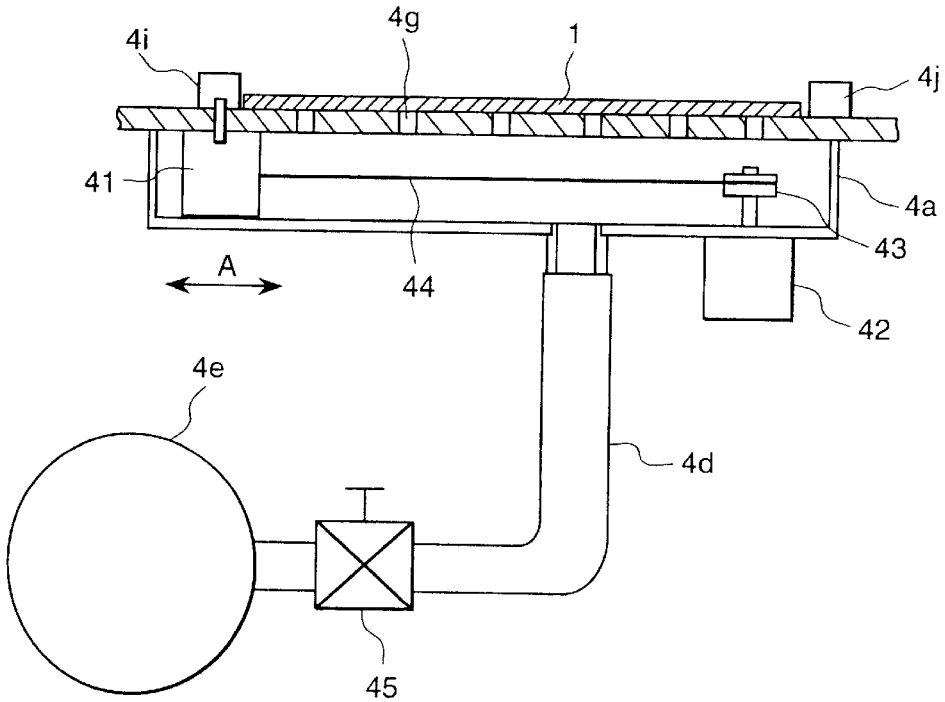
FIG. 3 is a cross-sectional view of the suction box constituting the web conditioning means.

In addition, it is preferable that at least either the web guide 4*i* or 4*j* on the suction box 4*a* should be provided in such a way as to be adjustable according to the particular width of the web. In this embodiment, as shown in FIG. 3, the web guide 4*j* is fixed, and the web guide 4*i* is provided so that it can be moved both toward and away from the web guide 4*j*, as denoted by arrow A. The moving mechanism for the web guide 4*i* can have this web guide fixed to, for example, a shutter member 41 provided inside the suction box 4*a*. The shutter member 41 opens or closes the through-holes 4*g*, depending on the particular width of the web, and is provided as a suction area adjusting member inside the suction box 4*a*. For this purpose, a motor 42 that can be rotated both forward and backward drives a pulley 43. Thus, the shutter member 41 connected to a wire 44 is moved in the direction of arrow A and the web guide 4*i* is moved in synchronization with the movement of the shutter member.

Numeral 45 in FIG. 3 denotes a valve for regulating the flow rate of the air sent from the blower 4*e*, and this valve controls the flow rate of the air to the optimum value according to the particular width and ream weight of the web.

In addition to having its traveling position adjusted during passage along the surfaces of the suction box 4*a* and the suction heater 4*b*, web 1 has its internal moisture evaporated to the required level by heating. After web 1 has been pulled out from the suction heater 4*b*, fixed tension is assigned to the web during passage along the route constructed so that the web is taken up by a plurality of guide rollers 41 (in this embodiment, two pieces). Hot web 1 is then cooled to almost room temperature by coolers 4*c* provided at the immediately succeeding stage and is fed onto feed rollers 5 and 6.

The web 1 fed in S-form around the feed rollers 5 and 6 is conveyed into a dancer roller mechanism 8 via a guide roller 7. The dancer roller mechanism 8 is used for assigning fixed tension to the web 1 being fed and consists of a dancer roller 8*a*, an arm 8*b* for supporting the dancer roller 8*a*, and a weight 8*c*. The arm 8*b* is provided so that it can be oscillated in the direction of the arrow around a shaft 8*d* and so that when the arm 8*b* is oscillated, the dancer roller 8*a* moves vertically in synchronization with the oscillation. The weight 8*c* is provided at the free end of the arm 8*d* (instead of using the weight, a spring can also be provided in strapped form between the free end of the arm 8*d* and a fixed portion such as a frame).

After being passed through the dancer roller mechanism 8, web 1 is fed to a skew correction mechanism 10 via a guide roller 9. The skew correction mechanism 10 consists of two rollers provided in parallel for position restriction and a sensor 10*c* for detecting the edges of the web 1 fed. The position restriction rollers 10*a* and 10*b* are rotatably supported by frame 10*d* under their parallel maintained status, and these rollers are constructed so that both can be rotationally moved at the same time by rotating the frame 10*d* around the shaft 10*e*. The amount of rotation of the frame 10*d* supporting the position restriction rollers 10*a* and 10*b* is controlled according to the particular output from the sensor 10*c*.

The web 1 that has been passed through the skew correction mechanism 10 is fed to an image forming section 12 via a guide roller 11. The present invention does not limit the structure of the image forming section 12. In this embodiment, however, an image forming section is exemplified as having a configuration in which a toner image is formed on a photosensitive material using a known electrophotographic process, and the embodiment includes a structure in which a color image is formed on one side of web 1 by four imaging portions, 12*a*, 12*b*, 12*c*, and 12*d*.

The structure of the imaging portions will be described below, taking imaging portion 12*a* as an example. Numeral 121 in the figure denotes a photosensitive drum. When the photosensitive drum 121 starts rotating, a high voltage is applied to a corona charger 122 and the surface of the photosensitive drum 121 is uniformly charged. A laser beam that has been emitted from a light source 123 including a semiconductor laser, photo-emitting diodes, etc., provides the surface of the photosensitive drum 121 with image exposure and forms an electrostatic latent image on the drum 121. When the photosensitive mate rial drum area holding this latent image reaches a position that faces an image developing unit 124, a developing agent is supplied to the electrostatic latent image and a toner image is formed on the surface of the photosensitive drum 121. The toner image that h as been formed on the photosensitive drum 121 is attracted onto web 1 by the action of a transfer unit 125 by which a charge of opposite polarity to that of the toner image is assigned to the reverse side of web 1. The area that has passed the transfer position of the photosensitive material roller 121 is cleaned by a cleaning unit 126 in order to prepare for the next printing operation.

In the way described above, after the toner image has been transferred from the four imaging portions, 12*a*, 12*b*, 12*c*, and 12*d*, to web 1, the toner image is fixed by the passage of the web through a heater 13 and the web is unloaded from the printer via guide rollers 14, 15, and 16. After this, the web is carried to a post-processor (not shown in the figure), where the printer then performs the required processes, such as cutting, stapling, and punching, on the web to complete the series of operations.

Although the description presented above assumes a configuration in which four imaging portions are arranged in line on one side of the web, four more imaging portions can also be arranged on the other side of the web to apply the present invention to a printer capable of forming color images on both sides of the web.

In addition, the application of the imaging portions is not limited to electrophotographic processes, and these portions can use ink jet recording or are applicable to impact recording that uses an ink ribbon and a printing hammer, or to other known recording schemes. In the case of electrophotographic processes, the heater 13 functions as a toner image fixing unit. In the case of ink jet recording, however, this heater can be used as a means of drying the ink recorded on the web.

Furthermore, the applicable web type is not limited to a roll-wound type, and a web of the type which is folded in zigzag form along seams can also be used.

As set forth above, according to the present invention, it is possible to provide a printer and printing method that enables stable feed of webs at high accuracy by maintaining almost constant web status, irrespective of the web type, prior to feeding the web to the image forming means of the printer. It is also possible to obtain a printer and printing method by which, since any extra moisture contained in the web is removed by the web conditioning means prior to the formation of an image, the thermal load on the heating means located at the stage succeeding the image forming means can be reduced and the image formed on the web fed at high speed can be fixed or dried using a compact heating means.

What is claimed is:

1. A printer comprising:

a web conditioning means for providing control of a moisture constant within a continuous web during web feeding, where the web conditioning means has a suction box which includes a web guide member means movably adjustable in response to a width of the web being fed, and a suction heater which incorporates heaters and heats the web passing thereon while suctioning the same;

a skew correction means for adjusting a traveling position of the web which has been passed through the web conditioning means;

a tension means provided on a web feed route between the web conditioning means and the skew correction means, for providing predetermined tensioning to the web; and an image forming means for forming an image on the web having passed through the skew correction means.

2. A printer according to claim 1, where the web guide member is movably adjustable to the width of the web while being interlocked with a shutter member within the suction box.

3. A printer according to claim 2, wherein movable adjustment of the web guide member to adjust to the width of the web causes the interlocked shutter member to open or close suction through-holes in the suction box to adjust to the width of the web.

4. A printer according to claim 2, where the web conditioner means comprises a web cooler disposed at a downstream side of the suction heater.

5. A printer according to claim 1, where the web conditioning means comprises a valve arrangement to control an air flow of the suction box to an optimum value based on the width of the web.

6. A printer according to claim 1, where the web conditioner means comprises a web cooler disposed at a downstream side of the suction heater.

7. A printer according to claim 1, where the skew correction means comprises detector means for detecting side edge positions of the web, and a movable roller mechanism for correcting a side-to-side traveling position of the web based on an output from the detector means.

8. A printer comprising:

a web conditioner to control a moisture constant within a continuous web during web feeding, where the web conditioner has a suction box which includes a web guide member movably adjustable in response to a width of the web during web feeding, and a suction heater which incorporates heaters and heats the web passing thereon while suctioning the same;

a skew corrector to adjust a traveling position of the web which has been passed through the web conditioner;

a web tensioner provided on a web feed route between the web conditioner and the skew corrector, to provide predetermined tensioning to the web; and an imager to form an image on the web after having passed through the skew corrector.

9. A printer according to claim 8, where the web guide member is movably adjustable to the width of the web while being interlocked with a shutter member within the suction box.

10. A printer according to claim 9, wherein movable adjustment of the web guide member to adjust to the width of the web causes the interlocked shutter member to open or close suction through-holes in the suction box to adjust to the width of the web.

11. A printer according to claim 9, where the web conditioner means comprises a web cooler disposed at a downstream side of the suction heater.

12. A printer according to claim 8, where the web conditioner comprises a valve arrangement to control an air flow of the suction box to an optimum value based on the width of the web.

13. A printer according to claim 8, where the web conditioner means comprises a web cooler disposed at a downstream side of the suction heater.

14. A printer according to claim 8, where the skew corrector comprises a detector to detect side edge positions of the web, and a movable roller mechanism to correct a side-to-side traveling position of the web based on an output from the detector.

* * * * *